United States Patent [19]

Bradford

[11] Patent Number: 4,844,281

[45] Date of Patent: Jul. 4, 1989

[54] ACCESSORY, FOR USE WITH A CONTAINER OF PRESERVATIVE

[76] Inventor: Ruth C. Bradford, 25 Meadow Dr., Little Falls, N.J. 07424

[21] Appl. No.: 252,664

[22] Filed: Oct. 3, 1988

[51] Int. Cl.[4] ..... B65D 25/10

[52] U.S. Cl. ..... 220/90; 15/257.05; 206/361

[58] Field of Search ..... 15/275.05; 206/209, 206/361; 220/85 D, 85 H, 90

[56] References Cited

U.S. PATENT DOCUMENTS

| | | | |
|---|---|---|---|
| 2,564,979 | 8/1951 | Jorgensen | 220/85 D |
| 2,921,330 | 1/1960 | Prytikin | 15/257.05 |
| 3,395,828 | 8/1968 | Schnab | 220/90 |
| 3,406,812 | 10/1968 | Henry | 206/361 |
| 4,014,453 | 3/1977 | Tarnacki | 220/90 |
| 4,014,465 | 3/1977 | Ritter | 220/90 |
| 4,203,537 | 5/1980 | McAlister | 220/90 |
| 4,225,064 | 9/1980 | Wescott | 220/90 |
| 4,583,666 | 4/1986 | Buck | 220/90 |
| 4,615,456 | 10/1986 | Cousar | 220/90 |

FOREIGN PATENT DOCUMENTS

| | | | |
|---|---|---|---|
| 0209718 | 12/1955 | Australia | 220/90 |
| 0972724 | 8/1975 | Canada | 220/90 |
| 0278429 | 10/1927 | United Kingdom | 220/90 |

*Primary Examiner*—Jimmy G. Foster

*Attorney, Agent, or Firm*—Bernard J. Murphy

[57] ABSTRACT

The Accessory is a shell having an up-right for supporting a paint brush thereagainst, and a web, with a plurality of drain holes formed therein to permit excess paint, or the like to drain therethrough. Integral with the shell is a circular limb, extending therefrom in a normal attitude, and the shell and limb, together define a U-shaped channel for engagingly shrouding the rim of an open container of paint, stain, varnish, shellac, or the like. The web bridges across a lowermost portion of the shell. Too, the shell has an uppermost land, with a cut-out formed therein. A paint brush can be set upon the web, with the handle thereof engaged with the cut-out, and be supported thus to allow it to drain into the container with which the channel is engaged.

5 Claims, 2 Drawing Sheets

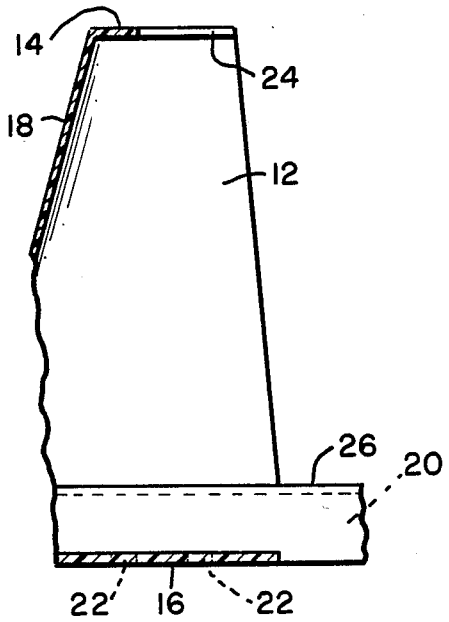
FIG. 3
FIG. 5
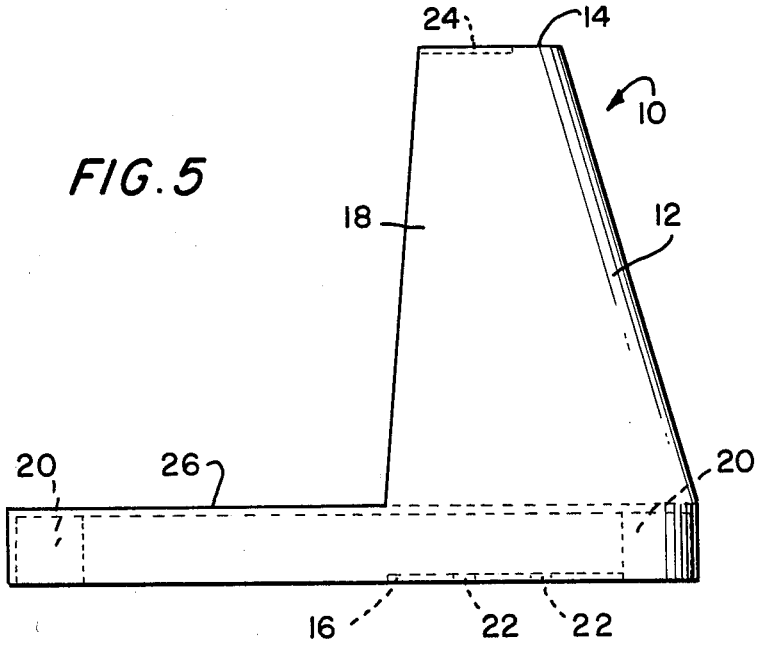

ACCESSORY, FOR USE WITH A CONTAINER OF PRESERVATIVE

This invention pertains to accessories which are useful in the practice of applying liquid preservatives, such as paint, stain, varnish, shellac, and the like, to surfaces, and in particular to such an accessory for use with a container of such preservative.

Commonly, containers of paint, and the like, have a gutter which is formed in the rim thereof to receive the annular rib of the cover. Now, during the practice of applying paint, or such preservative, to a surface, unavoidably some quantity of the paint is collected in the gutter and, in due course, runs over and down the side of the container. Too, with a halt of the work, when the cover is replaced on the container, two unfortunate things occur. For one, the rib of the cover displaces the gutter-collected paint, creating a mess. Also, such gutter-collected paint, or the like, sets up and acts like an adhesive. It virtually cements the cover to the rim of the container. Re-opening of the container, then, becomes a most difficult chore.

There has been a long, unsatisfied need, therefore, for an accessory for use with a container of preservative which will inhibit the occurrence of the aforesaid mess and avoid the cementing of the cover to the container. It is an object of this invention to set forth just such a needed accessory.

It is particularly an object of this invention to set forth an accessory, for use with a container of preservative such as paint, varnish, shellac, stain, or the like, comprising a shell; said shell having means for engagingly shrouding an arcuate portion of the rim of an open container of such preservative; and a limb joined to said shell; wherein said limb also has means for engagingly shrouding all of such rim except said arcuate portion thereof.

Further objects of this invention, as well as the novel features thereof, will become more apparent by reference to the following description taken in conjunction with the accompanying figures, in which:

FIG. 3 is a partial cross-sectional view taken along section 3—3 of FIG. 2;

FIG. 5 is a side elevational view taken from the right-hand side of FIG. 1.

Figure 1:
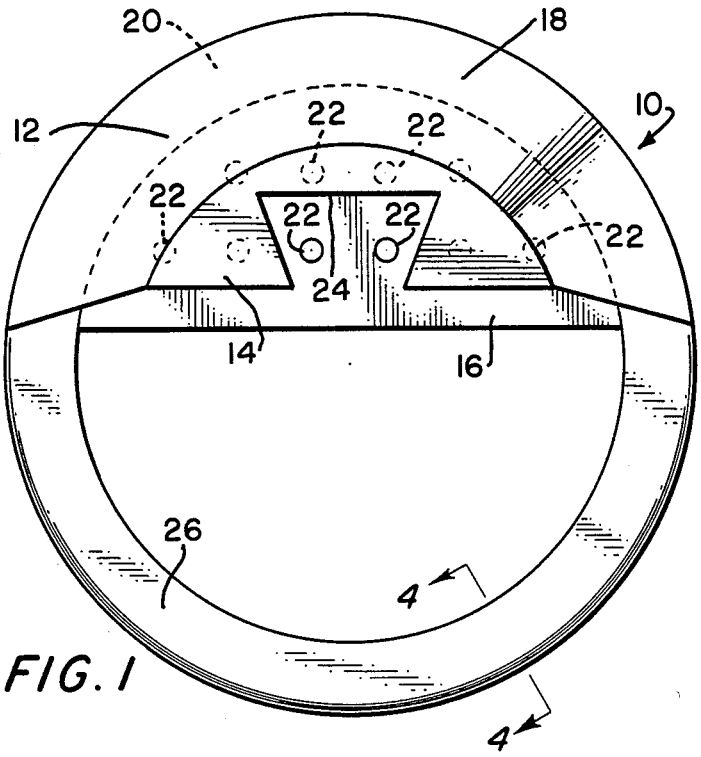
FIG. 1 is a plan, or top, view of the novel accessory according to an embodiment of the invention.
Figure 4:
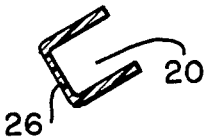
FIG. 4 is a cross-sectional view taken along section 4—4 of FIG. 1.
Figure 2:
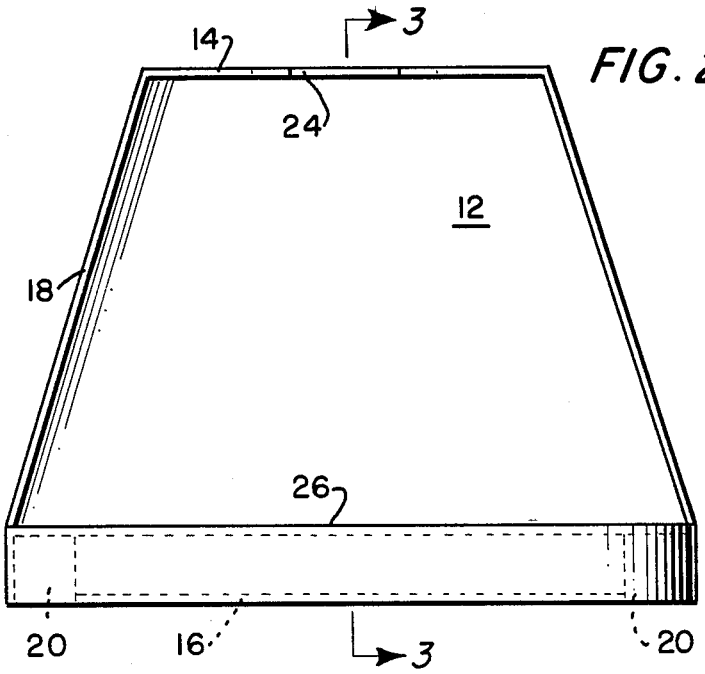
FIG. 2 is a front elevational view thereof.

As shown in the figures, the inventive accessory 10 comprises a shell 12 having a topmost land 14 and a lowermost web 16, the land 14 and web 16 being joined together by an arcuate wall 18 and an arcuate channel 20 of U-shaped cross-section. The web 16 has a plurality of drain holes 22 formed therein, and the land 14 has a dove-tail-shaped cut-out 24 formed therein.

Integral with the shell 12 is a limb 26, the same comprising a continuation of the arcuate channel 20 of the shell 12. The channel is provided for shroudingly engaging the rim of an open container of liquid preservative, such as paint or the like. The channel 20 of the shell and its continuation in the limb 26 sets on and over the open-container rim to prevent it from collecting paint therein. When a painter chooses to rest, he or she can set the brush, bristles down, upon the web 16, with the handle reposed in the cut-out 24. During the rest, the excess paint will drain through the holes 22 back into the container. When painting, the brush can be wiped against the inner surface of the rim-engaging limb 26, to remove excess paint, and none of the paint can collect in the gutter of the rim.

The web 16 runs back to the inner surface of the shell, so all the paint is safely captured. The cut-out 24 is formed of dove-tail shape to insure that the handle of the paint brush will be secure therein and can not slide down and out.

With the conclusion of a painting session, the accessory 10 can be removed from the rim of the container, and the container cover can be fastened in place. The rib of the cover will not cement to the gutter of the container, as the gutter will be free of paint. Too, with the securing of the cover to the container, as the gutter has no paint therein, paint will not spatter out.

The accessory 10, particularly if a latex paint has been used, can be washed clean for later re-use. Alternatively, the accessory 10 can be discarded. The same is of inexpensive plastic construction, in this embodiment thereof. Alternatively, of course, the accessory 10 can be formed of a non-metallic composition material. It is intended that the accessory 10 be formed in a variety of sizes to mate with standard-sizes of preservative containers.

While I have described my invention in connection with a specific embodiment thereof, it is to be clearly understood that this is done only by way of example, and not as a limitation to the scope of my invention as set forth in the objects thereof and in the appended claims.

I claim:

1. An accessory, for use with a container of preservative such as paint, varnish, stain, shellac, or the like, comprising:

a shell;

said shell having means for engagingly shrouding an arcuate portion of the rim of an open container of such preservative; and a limb joined to said shell; wherein said limb also has means for engagingly shrouding all of such rim except said arcuate portion thereof;

said shell further has means for bridging across ends of said arcuate portion of such rim for supporting thereon a preservative applicator, such as a brush;

said shell further has means for nestingly arresting a brush handle, or the like, therein against displacement;

said shell has a substantially flat land;

said brush handle arresting means comprises a cut-out formed in said land;

said land has a terminal edge; and said cut-out opens onto said edge across a given width thereof, and is closed inwardly of said land across a width which is greater than said given width.

2. An accessory, according to claim 1, wherein:

said supporting means comprises a web fully contiguous with said rim-shrouding means of said shell.

3. An accessory, according to claim 2, wherein:

said web has a plurality of drain holes formed therein.

4. An accessory, according to claim 1, wherein:

said shrouding means of said shell and said limb comprises a continuous channel.

5. An accessory, according to claim 4, wherein:

said channel, in cross-section, defines a U-shape.

* * * * *